US006216351B1

(12) United States Patent
Flubacher et al.

(10) Patent No.: US 6,216,351 B1
(45) Date of Patent: Apr. 17, 2001

(54) DAY AND NIGHT WEAPON SIGHTS

(75) Inventors: Paul A. Flubacher, Greenville; Julius H. Uhlmann, Huntsville, both of AL (US); Patricia Wilson, Plano, TX (US)

(73) Assignee: Highlander Sports, Inc., Huntsville, AL (US)

( * ) Notice: Subject to any disclaimer, the term of this patent is extended or adjusted under 35 U.S.C. 154(b) by 0 days.

(21) Appl. No.: 09/287,100

(22) Filed: Apr. 7, 1999

(51) Int. Cl.[7] ..... F41G 1/32
(52) U.S. Cl. ..... 33/241; 42/103; 33/261
(58) Field of Search ..... 42/103; 33/241

(56) References Cited

U.S. PATENT DOCUMENTS

| | | | | |
|---|---|---|---|---|
| Re. 35,347 | | 10/1996 | Bindon | 33/241 |
| 3,218,718 | * | 11/1965 | Hays | 33/241 |
| 3,500,545 | | 3/1970 | Chivers | 37/47 |
| 3,641,676 | * | 2/1972 | Knutsen et al. | 42/103 |
| 4,020,203 | | 4/1977 | Thuler | 33/241 |
| 5,070,619 | * | 12/1991 | Santiago | 33/242 |
| 5,101,589 | | 4/1992 | Duncan | 42/1.02 |
| 5,359,800 | * | 11/1994 | Fisher et al. | 42/103 |
| 5,471,777 | * | 12/1995 | McDonald | 33/241 |
| 5,519,941 | * | 5/1996 | Yusko | 33/252 |
| 5,638,604 | * | 6/1997 | Lorocco | 33/241 |
| 5,735,070 | | 4/1998 | Vasquez et al. | 42/1.02 |
| 5,862,618 | * | 1/1999 | Brown | 42/100 |
| 5,878,521 | | 3/1999 | Warnock | 33/241 |
| 5,956,854 | * | 9/1999 | Lorocco | 33/241 |
| 5,992,030 | | 11/1999 | Mann | 33/243 |
| 6,035,539 | * | 3/2000 | Hollenbach et al. | 42/103 |
| 6,058,615 | * | 5/2000 | Uhlmann et al. | 33/241 |

* cited by examiner

*Primary Examiner*—Michael J. Carone
*Assistant Examiner*—Denise Buckley
(74) *Attorney, Agent, or Firm*—Nixon & Vanderhye P.C.

(57) ABSTRACT

A day and night weapon sight includes a mounting base, a rod-shaped light guide fixed to the mounting base, and a self-luminescent capsule fixed to said mounting base vertically adjacent the light guide. Preferably, the light guide is formed of a rod-shaped fluorescently dyed transparent plastics material and the self-luminescent capsule includes a radioactive luminescent source (e.g., tritium).

15 Claims, 3 Drawing Sheets

DAY AND NIGHT WEAPON SIGHTS

FIELD OF THE INVENTION

The present invention relates generally to sighting devices for projectile weapons, such as archery bows and personal firearms. In preferred embodiments, the present invention relates to weapon sights which can be used effectively for both day and night weapon sightings.

BACKGROUND AND SUMMARY OF THE INVENTION

Projectile weapons, especially personal firearms, such as rifles, shotguns and pistols, are typically aimed at targets using some form of sighting device. In this regard, the sighting device is typically fixed to the gun in alignment with the sight line of the gun barrel. In such a manner, the gun's barrel may be brought to bear on a visually acquired target so that a high likelihood exists that the target will be hit when the gun is discharged.

In copending U.S. patent application Ser. No. 09/038,065 filed on Mar. 11, 1998 (the entire content of which is expressly incorporated hereinto by reference), there are disclosed gun sights which include one or more rod-shaped light guides. In preferred embodiments, the gun sights of the copending '065 patent application include one or more light guides that are formed from a suitable optically clear plastics material and dyed or colored with a fluorescent pigment to enhance their visibility.

While the gun sights disclosed in the copending '065 patent application are entirely satisfactory for daylight gun sightings, their use at night is limited due to the minimal amount of ambient light that is usually available.

Broadly, the present invention is embodied in combination day and night weapon sighting devices which necessarily include at least one rod-shaped light guide and a visible self-luminescent capsule closely vertically adjacent thereto.

BRIEF DESCRIPTION OF THE ACCOMPANYING DRAWINGS

Figure 1:
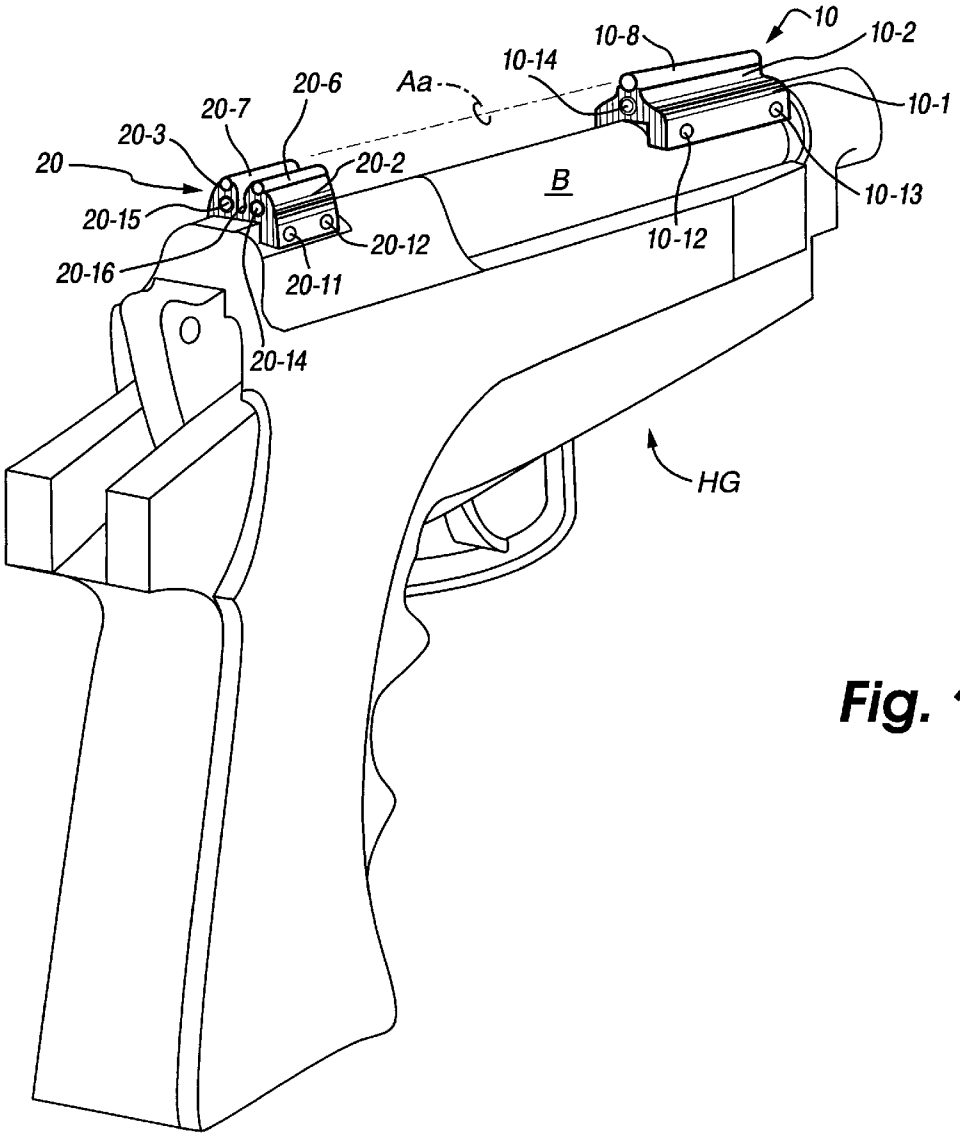
Figure 2:
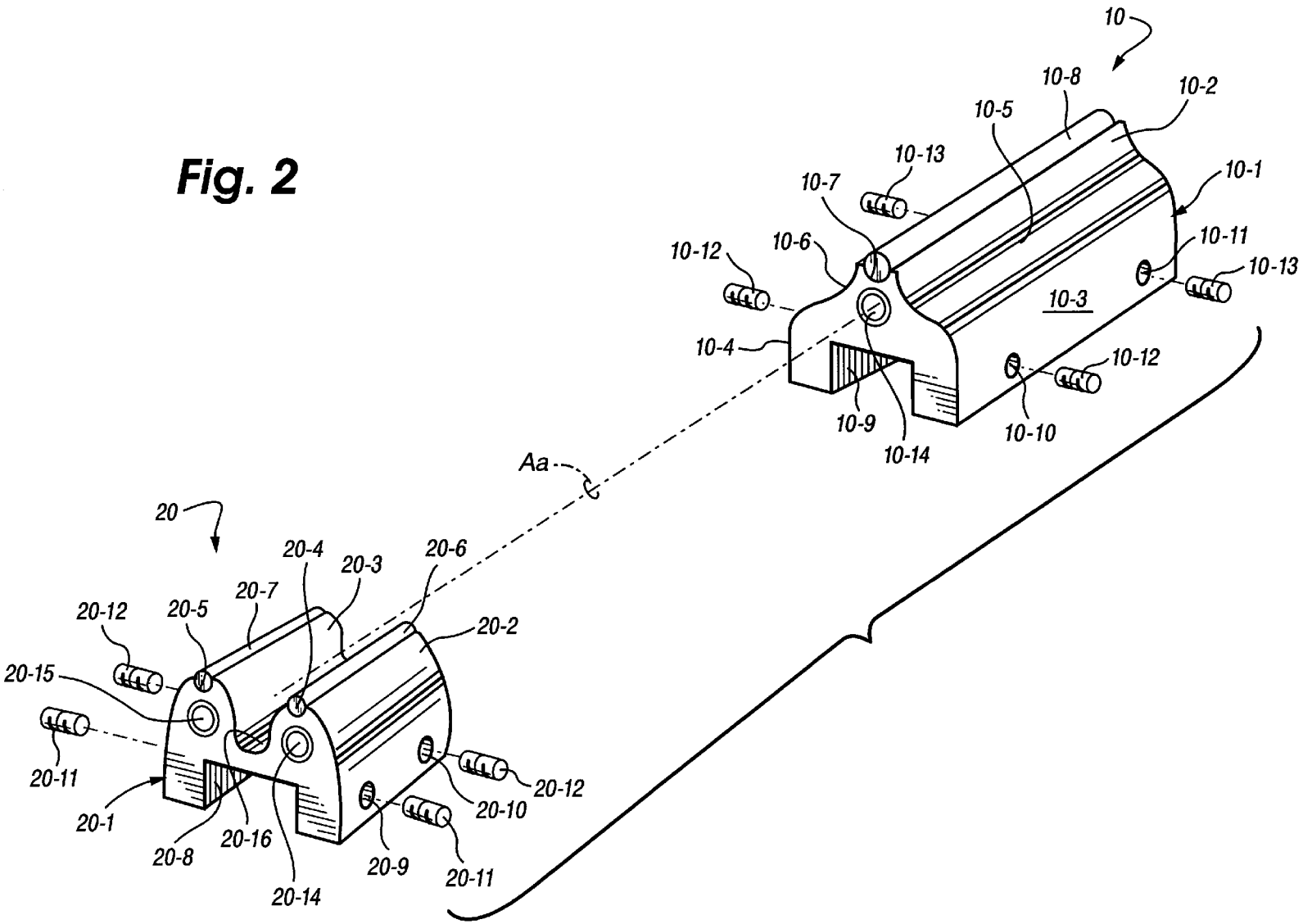
Figure 3:
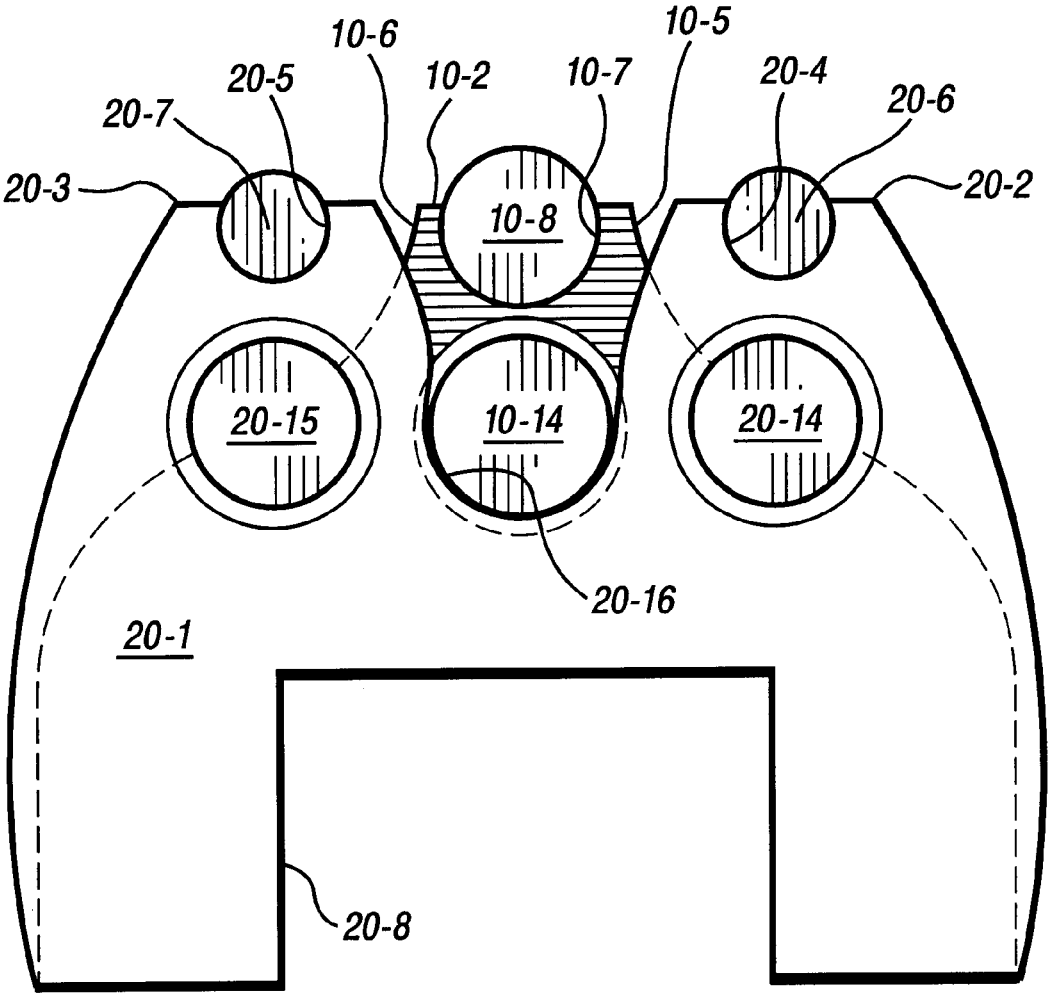

Reference will hereinafter be made to the accompanying drawings wherein like reference numerals throughout the various FIGURES denote like structural elements, and wherein, FIG. 1 is a rear perspective view of a handgun which is provided with front and rear gun sights in accordance with the present invention;

FIG. 2 is an enlarged rear perspective view of the gun sights employed on the handgun depicted in FIG. 1; and FIG. 3 is an even further enlarged rear elevation view showing front and rear gun sight alignment.

DETAILED DESCRIPTION OF THE INVENTION

Front and rear gun sights 10, 20, respectively, in accordance with one embodiment of the present invention are shown in accompanying FIG. 1 positioned along the sight line of a typical handgun HG. In this regard, it will be appreciated that, although the sights 10, 20 in accordance with the present invention are depicted in FIG. 1 as being mounted to handgun HG and will be described in greater detail in that exemplary environment of use, the gun sights disclosed hereinafter also find utility when combined with shoulder-mounted firearms (e.g., rifles, shotguns and the like) as well as archery bow weapons.

It will be observed that the front sight 10 is positioned along the barrel B of the handgun HG at its forward end, while the rear gun sight is aligned with the front sight along the barrel, but positioned at its rearward end. In such a manner, therefore, the user of the handgun HG will be able to bring the barrel B to bear accurately on a visually acquired target by bringing the front and rear sights 10, 20, respectively, into visual alignment with one another and with the intended target. By aiming the handgun HG in this way, the user will have a high probability of striking the target when discharged.

The gun sights 10, 20 are shown in greater detail in accompanying FIG. 2. In this regard, it will be observed that the front gun sight includes an axially elongate mounting base member 10-1. The base member 10-1 is provided with an upwardly projecting, central ridge 10-2. The ridge 10-2 is joined to side walls 10-3, 10-4 by opposed, concave transition surfaces 10-5, 10-6, respectively. The ridge 10-2 is itself provided at its apex with an axially extending semicylindrical concave surface 10-7 which conforms closely to the circular cross-section of the rod-shaped light guide 10-8.

The mounting base 10-1 also defines a lower channel 10-9 extending its entire lengthwise dimension. The channel 10-9 is dimensioned so as to fit onto the barrel B of the handgun HG. The base 10-1 is also provided with opposed pairs of set screws 10-10, 10-11 and corresponding threaded apertures 10-12, 10-13, respectively. The threaded apertures 10-10, 10-11 extend substantially perpendicularly to the longitudinal dimension of the channel 10-9 and thereby allow their respective set screws 10-12, 10-13 to extend into the channel 10-9. The proximal ends of the set screws 10-10, 10-11 are provided with suitable surfaces to accept a turning tool, while the distal ends thereof enter the channel 10-9 and bear against the barrel B of the handgun HG so as to positionally fix the mounting base 10-1, and hence the sight 10, thereto.

Importantly, the front sight 10 is also provided with a fixed-position, self-luminescent capsule 10-14 which continuously emits a point or dot of light. Most preferably, the self-luminescent capsule 10-14 is a radioactive luminescent source, such as tritium, as disclosed more fully in U.S. Pat. Nos. 4,020,203; Re. 35,347 and 5,878,521 (the entire content of each being incorporated expressly hereinto by reference). The capsule 10-14 is fixedly inserted into the rearward vertical surface of the mounting base 10-1 so as to be in close vertical alignment with the rearward end of the light guide 10-8. Specifically, the capsule 10-14 is aligned with a vertical plane parallel to the aiming axis Aa which bisects both the capsule 10-14 and the light guide 10-8.

The rear sight 20, like the front sight 10, includes a mounting base 20-1 provided with a laterally separated (relative to the aiming axis Aa) parallel apical protrusions 20-2, 20-3. Each protrusion includes a semicylindrical concave surface 20-4, 20-5 which receive therein a respective one of the rod-shaped light guides 20-6, 20-7. A generally rectangular lower channel 20-8, and paired threaded apertures 20-9, 20-10 and set screws 20-11, 20-12 are proved for the same purposes as their corresponding structure in front sight 10 - that is, to positionally fix the sight 20 to the barrel B of the handgun HG.

The rearward vertical surface of each of the apical protrusions 202, 20-3 is provided with self-luminescent capsules 20-14, 20-15, respectively. Each of the self-luminescent capsules is inserted into the rear surface of the apical protrusions 20-2, 20-3 so as to be fixedly positioned immediately vertically adjacent the rearward end of the light guides 20-6, 20-7, respectively. That is, a vertical bisecting plane parallel to the aiming axis $A_a$ bisects both the capsules 20-14, 20-15 and their respective the light guides 20-6 and 20-7.

The apical protrusions 20-2 and 20-3 are separated by a semi-cylindrical valley 20-16 which extends longitudinally in alignment with the aiming axis $A_a$. Most preferably, the radius of the semi-cylindrical surface is in close conformance to the radius of the capsule 10-14 of the front sight 10. In addition, as is evident from FIG. 3, the generatrices of the semi-cylindrical valley 20-16 are aligned with a horizontal plane which bisects both the capsules 20-14 and 20-15 as well as the capsule 10-14 when the front and rear sights 10, 20, respectively, are aligned along the aiming axis $A_a$. When aligned in such a manner as depicted in FIG. 3, the user of the handgun HG will be visually confident that the handgun HG is aimed properly.

It will be noted that the relative diameter of the light guide 10-8 is different as compared to the diameters of each of the light guides 20-6, 20-7. More specifically, the diameter of the front light guide 10-8 is approximately at least about 25% larger than the diameters of the rear light guides 20-6, 20-7. Thus, when the front and rear sights 10 and 20, respectively, are longitudinally separated along the barrel B of the handgun HG as shown in FIG. 1, the perceived diameter of the front light guide 10-8 will decrease so that it visually appears to be substantially the same diameter as the pair of rear light guides 20-6, 20-7. In other words, FIG. 3 shows the literal non-perspective dimensional relationship between the light guides 10-8 on the one hand, and the light guides 20-6, 20-7 on the other hand. In use, the sight picture will be such that the front light guide 10-8 will appear to have substantially the same diameter as the light guides 20-6, 20-7 since the front and rear sights 10, 20 will be viewed in a background/foreground perspective. The relative diameters of the front and rear light guides 10-6 and 20-6, 20-7 can therefore be selected in dependence upon their relative separation distance when positioned on a weapon so that the relative diameters of the front and rear light guides 10-6 and 20-6, 20-7 will visually appear to be substantially the same when a user aims the weapon.

The light guides employed in the gun sights of the present invention are, in and of themselves, highly conventional. In this regard, the light guides are typically formed from a suitable optically clear plastics material such as polystyrene, polyacrylic or polytetrafluoroethylene, and are most preferably dyed or colored with a fluorescent pigment to enhance their visibility. The light guide may optionally be provided with an optically transparent coating thereon of a suitable plastics material and/or may be provided with a scratch-resistant sleeve member. The light guides are rod-shaped elements having lengths between about 0.50 to about 1.5 inches and a diameter between about 0.055 to about 0.250 inch and more preferably between about 0.075 to about 0.125 inch. In particularly preferred embodiments, the light guides for the front and rear sights 10, 20, respectively, will be between about 0.60 and about 1.40 inch in length (±0.015 inch) and will have diameters ranging between about 0.090 to about 0.118 inch (±0.004 inch).

Similarly, the self-luminescent capsule 10-14 is somewhat larger in diameter as compared to the capsules 20-14 and 20-15 for the same reasons noted above. Most preferably, the capsules will have a diameter of between about 0.050 to about 0.100 inch, with the front capsule 10-14 being typically about 0.094 inch and the rear capsules 20-14, 20-15 being about 0.087 inch. In use, therefore, the front capsule 10-14 will visually appear to be smaller than its actual diameter so as to appear roughly equivalent in diameter as compared to the rear capsules 20-14, 20-15 for the same reasons noted previously.

The vertical separation distances of the light guides and self-luminescent capsules will depend upon the specific diameters employed. Preferably, the light guides and capsules are positioned as closely adjacent as possible without affecting the structural integrity of the sight. For example, the closest parallel lines tangent to the circumferences of the light guide and the capsules will usually be separated by a distance of less than about 0.050 inch, and typically less than about 0.035 inch.

Because of the relatively close vertical separation between the light guides 10-8, 20-6 and 20-7 and their respective self-luminescent capsules 10-14, 20-14 and 20-15, minimal elevational deviation will occur at the zeroed range of the sights 10, 20. As a result, the user can confidently use the sight pictures provided by the sights 10 and 20 for both day and night firing. That is, the light guides 10-8, 20-6 and 20-7 will be aligned and brought to bear on the target during daylight hours since they will be more clearly visible to the user. During low light and night light conditions, however, the self-luminescent capsules 10-14, 20-14 and 20-15 will be more clearly visible thereby allowing them to be aligned and brought to bear on a target. In such a manner, therefore the sights 10, 20 can be employed for both day and night firing.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A day and night weapon sight for sighting a weapon at targets during day and night light conditions, comprising:

a mounting base having a rearward vertical surface, a rod-shaped light guide fixed to said mounting base so as to be aligned with a vertical plane which is parallel to an aiming axis of the weapon, and such that a rearward end of said light guide is visible at said rearward vertical surface of said mounting base, and a self-luminescent capsule having a radio-active luminescent source embedded in to said vertical surface of said mounting base vertically adjacent said light guide and parallel to the aiming axis so as to be aligned with said light guide along said vertical plane and separated from said light guide by a distance to cause minimal elevational deviation of the weapon to occur when the weapon is sighted at the target during both day and night light conditions.

2. The sight of claim 1, wherein said light guide is formed of a rod-shaped fluorescently dyed transparent plastics material.

3. The sight of claim 1, wherein said radioactive luminescent source is tritium.

4. The sight of claim 1, wherein said mounting base has at least one axially elongate, apical protrusion, and wherein said light guide is fixed to an upper region of said apical protrusion.

5. The sight of claim 4, wherein said apical protrusion includes an axially extending semi-cylindrical surface which receives said light guide therein.

6. The sight of claim 4, which includes a pair of said axially elongate, parallel apical protrusions laterally separated from one another, and a pair of said light guides each fixed to an upper region of a respective apical protrusion.

7. The sight of claim 6, further comprising a pair of said self-luminescent capsules each being fixed to said mounting base so as to be vertically adjacent a respective one of said light guides.

8. The sight of claim 7, wherein each said self-luminescent capsules includes tritium.

9. The combination comprising a projectile weapon and a sight of claim 1.

10. The combination of claim 9, wherein the projectile weapon is a personal firearm.

11. A weapon sighting system for sighting a weapon at targets during day and night light conditions, comprising:

a front sight and a rear sight mountable to a weapon so as to be aligned with one another along an aiming axis thereof, wherein said front sight includes;

a front mounting body having a central ridge extending longitudinally relative to the aiming axis and a rearward vertical surface;

a front light guide fixed to said central ridge and having a rear end visible at said rearward vertical surface of said front mounting body and aligned with a vertical plane which is parallel to the aiming axis of the weapon; and a front self-luminescent capsule having a radio-active luminescent source fixed to said rearward vertical surface of the front mounting body so as to be visibly vertically adjacent to said front light guide; and wherein said rear sight includes;

a rear mounting body having a rearward vertical surface and a pair of apical protrusions laterally separated from one another by a semi-cylindrical valley and oriented parallel relative to the aiming axis;

a pair of rear light guides fixed to a respective one of said apical protrusions and having respective rear ends which are visible at said rearward surface of said rearward mounting body and aligned with the vertical plane parallel to the aiming axis of the weapon; and a pair of rear self-luminescent capsules each having a radio-active luminescent source fixed to said rearward surface of the rear mounting body so as to be visibly vertically adjacent to respective ones of said rear light guides, wherein said front self-luminescent capsules and said rear luminescent capsules are aligned with said front light guide and one of said rear light guides, respectively, alone the vertical plane parallel to the aiming axis of the weapon and separated from front light guide and one of said rear light guides, respectively, by a distance causing minimal elevational deviation of the weapon when sighted at the target during day and night light conditions.

12. The weapon sighting system of claim 11, wherein said front and rear light guides are formed of a rod-shaped fluorescently dyed transparent plastics material.

13. The weapon sighting system of claim 11, wherein said radioactive luminescent source is tritium.

14. The combination comprising a projectile weapon and a sighting system of claim 11.

15. The combination of claim 14, wherein the projectile weapon is a personal firearm.

* * * * *